US008208833B2

(12) United States Patent
Kitagawa

(10) Patent No.: US 8,208,833 B2
(45) Date of Patent: Jun. 26, 2012

(54) IMAGE FORMING APPARATUS

(75) Inventor: Oki Kitagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 12/795,111

(22) Filed: Jun. 7, 2010

(65) Prior Publication Data

US 2010/0322667 A1 Dec. 23, 2010

(30) Foreign Application Priority Data

Jun. 22, 2009 (JP) ..... 2009-147329

(51) Int. Cl.
*G03G 15/16* (2006.01)

(52) U.S. Cl. ..... 399/122

(58) Field of Classification Search ..... 399/33, 399/67, 122, 320, 307, 322, 327, 400, 329, 399/328, 124
See application file for complete search history.

(56) References Cited

U.S. PATENT DOCUMENTS

| | | | | |
|---|---|---|---|---|
| 6,078,765 | A * | 6/2000 | Takano et al. | 399/124 |
| 2004/0190958 | A1* | 9/2004 | Matsumoto | 399/329 |
| 2007/0217839 | A1* | 9/2007 | Moteki et al. | 399/329 |
| 2009/0180792 | A1* | 7/2009 | Hayamizu | 399/67 |

FOREIGN PATENT DOCUMENTS

| | | |
|---|---|---|
| JP | 11-125985 | 5/1999 |

OTHER PUBLICATIONS

Chinese Office Action dated Jan. 18, 2012, in counterpart Chinese Application No. 201010213277.4, and English-language translation thereof.

* cited by examiner

*Primary Examiner* — Kiho Kim
(74) *Attorney, Agent, or Firm* — Fitzpatrick, Cella, Harper & Scinto

(57) ABSTRACT

An image forming apparatus includes a heater for heating a toner image formed on a recording material; a pressor for pressing the heater to form a nip in which the recording material is to be nipped and conveyed; device for permitting contact and separation between the heater and the pressor; a portion for executing a stand-by state in which the heater and the pressor are separated with a first distance therebetween and the apparatus is ready for input of an image forming signal; a detector for detecting the recording material present in the nip when an image forming operation is stopped; and a controller for controlling an operation of the device so that the heater and the pressor are separated with a second distance therebetween larger than the first distance at least when the detector detects the recording material present in the nip.

2 Claims, 9 Drawing Sheets

IMAGE FORMING APPARATUS

FIELD OF THE INVENTION AND RELATED ART

The present invention relates to an image forming apparatus, including a fixing device, such as an electrophotographic copying machine or an electrophotographic printer.

In the fixing device to be mounted in the electrophotographic copying machine or printer, a pair of rollers (two rollers) forms a fixing nip under pressure and in the fixing nip, either one or both of the rollers are heated to heat-fix a toner image on a recording material. Japanese Laid-Open Patent Application Hei 11-125985 discloses a constitution in which a pressure-releasing mechanism for releasing pressure in the fixing nip is provided and releases the pressure in the fixing nip during stand-by or during an occurrence of a jam not only to alleviate deformation of a fixing roller and a pressing roller but also to facilitate jam clearance.

However, when a distance between the pair of rollers during separation (spacing) is long, contact between the pair of rollers requires time and therefore the time required for returning a state of the pair of rollers to a state in which the pair of rollers can perform a heating operation is prolonged. On the other hand, if the distance between the pair of rollers is short, the jam clearance is not readily effected.

SUMMARY OF THE INVENTION

A principal object of the present invention is to provide an image forming apparatus capable of easily effecting jam clearance while shortening a time required for returning a state of a fixing device to a state in which the fixing device can perform an image heating operation.

According to an aspect of the present invention, there is provided an image forming apparatus comprising:

an image heating member for heating a toner image formed on a recording material;

a pressing member for pressing the image heating member to form a nip in which the recording material is to be nipped and conveyed;

contact-and-separation means for permitting contact and separation between the image heating member and the pressing member;

an executing portion for executing a stand-by state in which the image heating member and the pressing member are separated with a first distance therebetween and the image forming apparatus is ready for input of an image forming signal;

recording material detecting means for detecting the recording material present in the nip when an image forming operation is stopped; and a contact-and-separation means control portion for controlling an operation of the contact-and-separation means so that the image heating member and the pressing member are separated with a second distance therebetween larger than the first distance at least when the recording material detecting means detects the recording material present in the nip.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Image Forming Apparatus

Figure 1A:
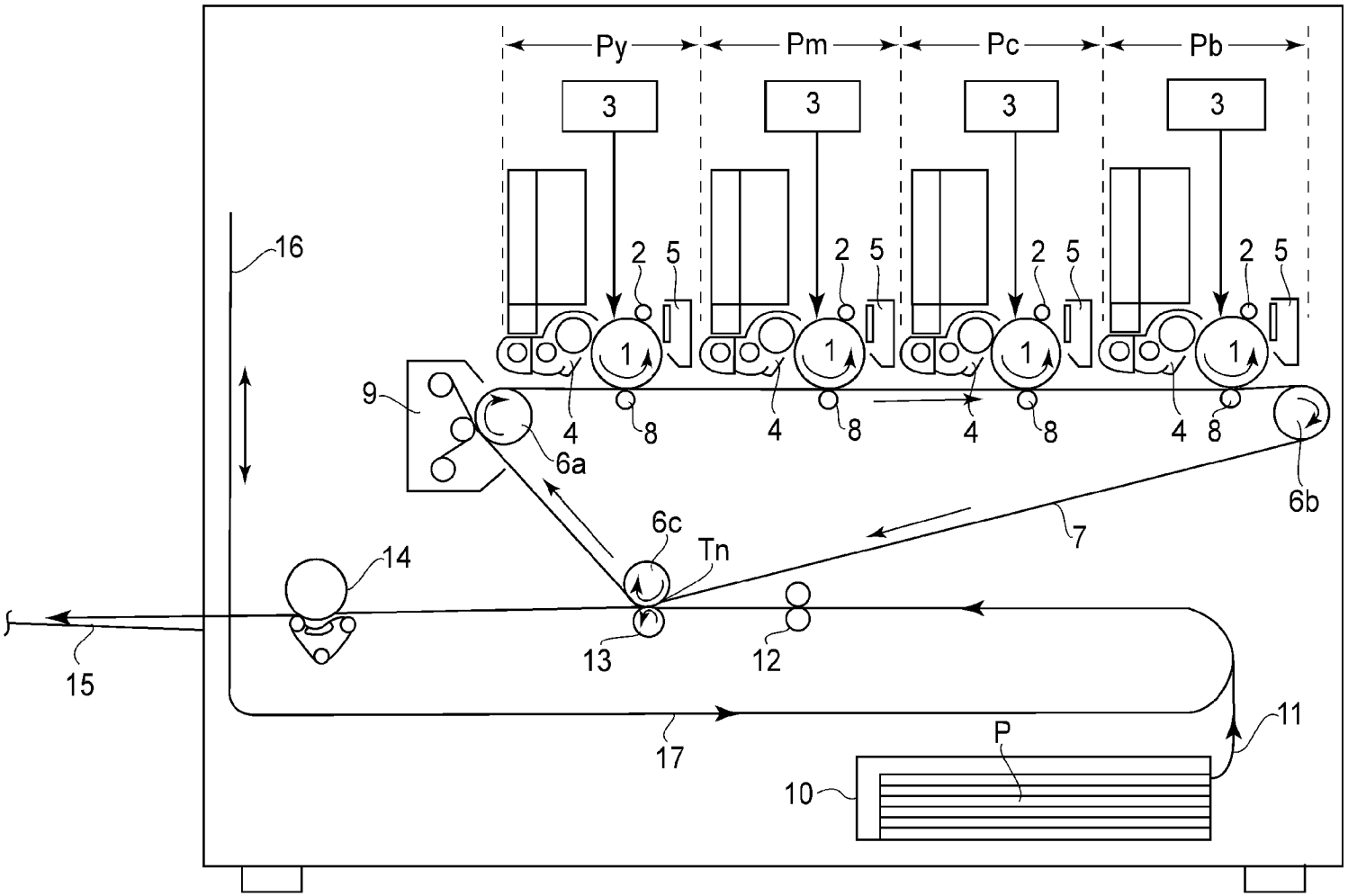
FIG. 1A is a schematic cross-sectional view of an image forming apparatus according to Embodiment 1 of the present invention.

FIG. 1A is a schematic cross-sectional view of an image forming apparatus in which an image heat device in the present invention is mountable as a fixing device. This image forming apparatus is a color printer of an electrophotographic type. The image forming apparatus in this embodiment has a process speed of 380 mm/sec and is capable of forming an image on 80 sheets (A4 size) per minute. In the image forming apparatus in this embodiment, first to fourth image forming portions, Ry, Pm, Pc and Pb are arranged side by side and can form four toner images different in color through processes of charging, exposure, development and transfer. The image forming apparatus in this embodiment starts an image forming operation, in accordance a predetermined image forming sequence, depending on print instructions output from an external device (not shown) such as a host computer. That is, the respective image forming portions Py, Pm, Pc and Pb are successively driven, so that each of photosensitive drums 1 as an image bearing member is rotated in a direction indicated by an arrow at a predetermined peripheral speed (process speed). An intermediary transfer belt 7 stretched around a driving roller 6*a*, a follower roller 6*b* and a tension roller 6*c* so as to extend over the photosensitive drums 1 of the first to fourth image forming portions Py, Pm, Pc and Pb is rotated in a direction indicated by arrows at a peripheral speed corresponding to the rotational peripheral speed of each of the photosensitive drums 1 by the driving roller 6*a*. First, at the first image forming portion for forming an image of a first color of yellow, an outer peripheral surface of the photosensitive drum 1 is electrically charged uniformly by a charger 2 to a predetermined polarity and a predetermined potential. Next, the charged surface of the photosensitive drum 1 is subjected to scanning exposure to laser light, correspondingly to image information from the external device, by an exposure device 3. As a result, an electrostatic latent image corresponding to the image information is formed on the surface of the photosensitive drum 1. The latent image is developed with yellow toner (developer) by a developing device 4. Similar processes of the charging, the exposure and the development are also performed at the second image forming portion Pm for forming an image of a second color of magenta, the third image forming portion Pc for forming an image of a third color of cyan and the fourth image forming portion Pb for forming an image of a fourth color of black. The respective color toner images formed on the surfaces of the photosensitive drums 1 at the respective image forming stations Py, Pm, Pc and Pb are successively transferred to be superimposed on each other onto the outer peripheral surface of the intermediary transfer belt 7 by primary transfer rollers 8 disposed opposed to the photosensitive drums 1 through the intermediary transfer belt. As a result, a full-color toner image is carried on the surface of the intermediary transfer belt 7. Separately, a recording material P is sent from a cassette 10 to registration rollers 12 through a sheet path 11 by a feeding roller (not shown). Then, the recording material P is conveyed into a secondary transfer nip Tn between the intermediary transfer belt 7 and a secondary transfer roller (transfer member) 13 by the registration rollers 12. In the secondary transfer nip Tn, the recording material P is nipped and conveyed by the intermediary transfer belt 7 and the secondary transfer roller 13 and during the conveyance process, the full-color toner image on the surface of the intermediary transfer belt 7 is transferred onto the surface of the recording material P by the secondary transfer roller 13. The recording material on which the unfixed full-color toner image is carried is introduced into a fixing device 13. Then, the recording material P is nipped and conveyed in a fixing nip N described later, so that the unfixed full-color toner image is heat-fixed. The recording material P coming out of the fixing device 14 is discharged, as the result of one-side printing, on a sheet discharge tray 15 located outside the image forming apparatus. On the photosensitive drum 1 after the toner image transfer, transfer residual toner remaining on the photosensitive drum 1 surface is removed by a drum cleaner 5, so that the photosensitive drum 1 prepares for subsequent image formation. On the intermediary transfer belt 7 after the full-color toner image transfer, transfer residual toner remaining on the surface of the intermediary transfer belt 7 is removed by a belt cleaner 9, so that the intermediary transfer belt 7 prepares for subsequent image formation. The above steps constitute an image forming operation in the case where a one-side copy mode is selected in the image forming apparatus in this embodiment. Next, an image forming operation in the case where a both-side copy mode is selected in the image forming apparatus will be described. In the case where the both-side copy mode is selected, the recording material P on which the image has already been formed at a first surface is introduced into a switch-back sheet path 16 of a re-circulating conveyance mechanism by a flapper (not shown). Then, the recording material P is pulled out of the switch-back sheet path 16 and is introduced into a re-conveying sheet path 17 and is then passed through the sheet path 11 and between the registration rollers 12, thus being re-introduced into the secondary transfer nip N in an upside-down state with predetermined timing. As a result, the toner image is secondary-transferred from the intermediary transfer belt 7 onto the recording material P at a second surface thereof. The recording material P which has been subjected to the toner image transfer onto the second surface in the secondary transfer nip N is separated from the intermediary transfer belt 7 and is then re-introduced into the fixing device 14. The recording material P is subjected to heat-fixing of the toner image and then is discharged, as the result of a both-side printing operation, on the sheet discharge tray 15 located outside the image forming apparatus.

(2) Fixing Device

Figure 1B:
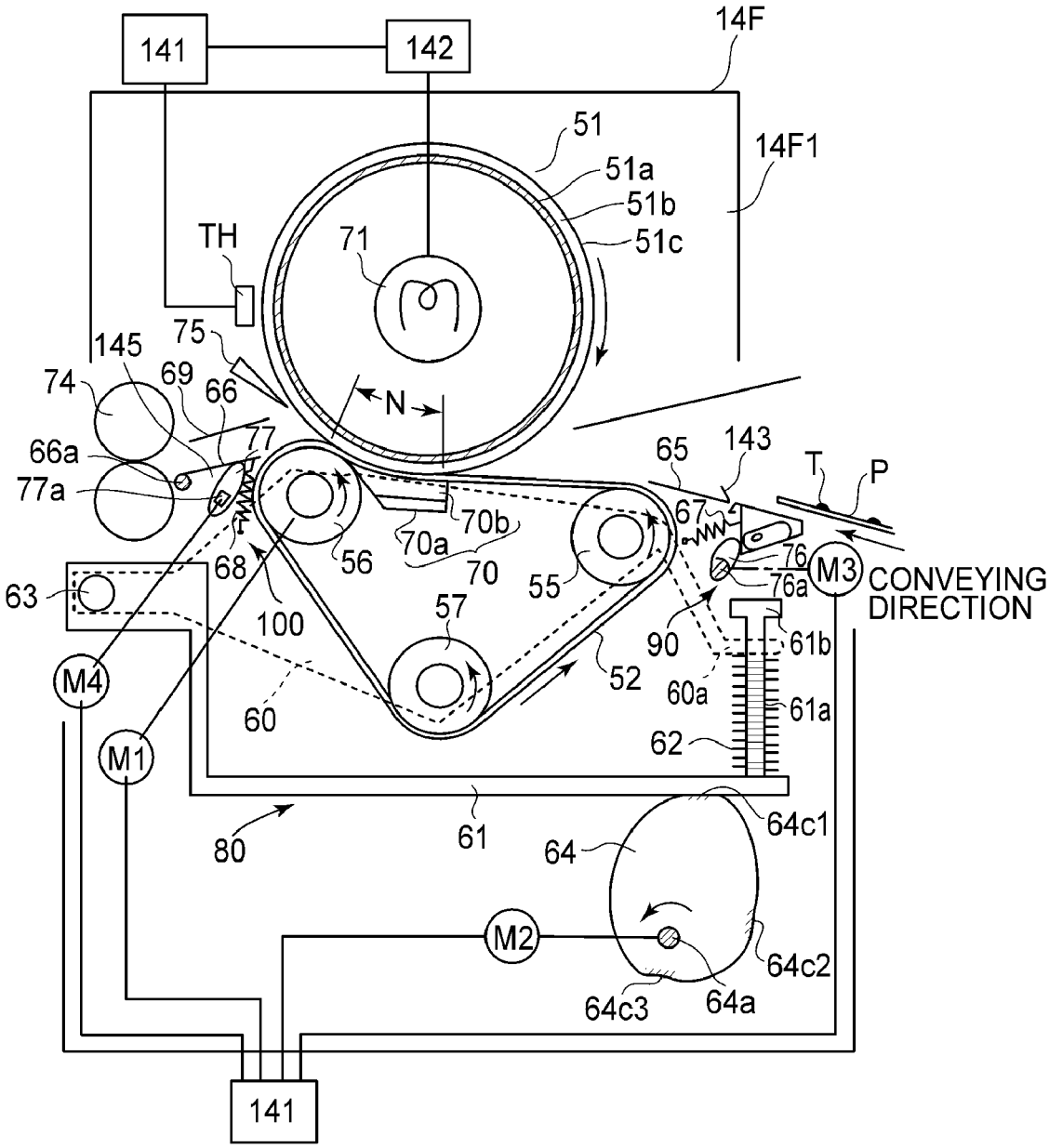
FIG. 1B is a schematic cross-sectional view of a fixing device in Embodiment 1 and shows a state in which a fixing nip is formed.

In the following description, with respect to the fixing device and the members constituting the fixing device, a longitudinal direction refers to a direction perpendicular to a recording material conveying direction on the surface of the recording material. A widthwise direction refers to a direction parallel to the recording material conveying direction on the surface of the recording material. A length refers to a dimension with respect to the longitudinal direction. A width refers to a dimension with respect to the widthwise direction. FIG. 1B is a schematic cross-sectional view of the fixing device in this embodiment and shows a state in which the fixing nip is formed. This fixing device is of a belt type. The fixing device 14 includes a fixing roller (image heating member) 51, a flexible endless belt (pressing member)) 52, a halogen lamp (heating member) 71, an introducing guide (entrance guide) 65, a discharging guide 66, and the like. Further, the fixing device 14 includes a fixing nip separation (removing) mechanism (contact-and-separation means) 80, an introducing guide moving mechanism (entrance guide moving means) 90, a discharging guide moving mechanism (discharging guide moving means) 100, and the like. The fixing roller 51 is prepared by forming a 2.5 mm-thick silicone rubber elastic layer 51*b*, in a belt shape, on an outer peripheral surface of a cylindrical metal core 51*a* of Fe having an outer diameter of 75 mm at a portion except for both longitudinal end portions of the cylindrical metal core 51*a* and then by coating a 30 μm-thick PFA tube as a parting layer 51*c* on the outer peripheral surface of the elastic layer 51*b*. The fixing roller 51 is rotatably supported by a side plate pair 14F1 of a device frame 14F of the fixing device 14 at the both longitudinal end portions of the cylindrical metal core 51*a* of the fixing roller 51. The halogen lamp 71 for heating the fixing roller 51 is provided inside the cylindrical metal core 51*a* of the fixing roller 51. Both longitudinal end bases (not shown) of the lamp 71 are supported by the side plate pair 14F1. The fixing nip separating mechanism 80 includes pressing arms (supporting member) 60 disposed below the fixing roller 51 on one longitudinal end side and the other longitudinal end side of the fixing roller 51 and includes a pressing bottom plate (pressing separation member) 61 and the like disposed below the pressing arm 60. Each of the pressing arms 60 is swingably supported by a supporting shaft 63 provided on the side plate pair 14F1 at a downstream-side end portion thereof with respect to the recording material conveying direction. The pressing bottom plate 61 is swingably supported by the supporting shaft 63 at the downstream-side end portion thereof with respect to the recording material conveying direction. The pressing bottom plate 61 includes a spring holding portion 61*a* at both longitudinal end portions on an upstream side of the fixing device 14 with respect to the recording material conveying direction. With each of the spring holding portions 61*a*, a spring receiving portion 60*a* provided at a downstream-side end portion of each pressing arm 60 with respect to the recording material conveying direction is movably engaged. A cam (spacing amount setting member) 64 disposed under the pressing bottom plate 61 at the downstream-side portion of the pressing bottom plate 61 with respect to the recording material conveying direction is supported by a cam shaft 64*a* provided on the side plate pair 14F1. On the other peripheral surface of the cam 64, three (first to three) cam surfaces 64*c*1, 64*c*2 and 64*c*3 are formed, and the first cam surface 64*c*1 having a largest distance from the cam shaft 64*a* contacts the pressing bottom plate 61. Between the pressing arms 60, the endless belt 51 is stretched around three rollers 55, 56 and 57 disposed at predetermined portions. Each of the rollers 55, 56 and 57 is rotatably supported by the pressing arms at both of their longitudinal end portions. That is, the belt 52 is supported by the pressing arms 60 through the rollers 55, 56 and 57. Between the rollers 55 and 56, a pressing pad 70 is provided. The pressing pad 70 is supported by the pressing arms 60 at its both longitudinal end portions. At each of the spring holding portions 61*a* of the pressing bottom plate 61, a pressing spring (pressing member) 62 is provided under the spring receiving portion 60*a* of each of the pressing arms 60. The pressing spring 62 urges the roller 56 and the pressing pad 70 against the belt 52 so as to press the outer peripheral surface of the fixing roller 51 in a state in which the spring receiving portion 60*a* of each of the pressing arms 60 is separated from a stopper 61*b* provided at an upper end of each of the spring holding portions 61*a*. As a result, between the surface of the fixing roller 51 and the outer peripheral surface of the belt 52, the fixing nip (heating nip) N having a predetermined width is formed.

In the fixing nip separation mechanism 80, the belt 52 is prepared by coating a 300 μm-thick silicone rubber elastic layer on an outer peripheral surface of a 75 μm-thick endless base member of polyimide resin and then by coating a 30 μm PFA tube as a parting layer on the outer peripheral surface of the elastic layer. The material for the base member of the belt 52 is not limited to the polyimide resin but as the material, it is also possible to use metal such as SUS or Ni. The roller 56 is a separation roller formed of metal having an outer diameter of 20 mm. The roller 56 presses the belt 52 so as to be engaged on the surface of the fixing roller 51 and elastically deforms the elastic layer 51*b* of the fixing roller 51, thus permitting the recording material P to be separated from the surface of the fixing roller 51. In this embodiment, the total pressure in the fixing nip N is about 686 N (about 70 kgf) and the fixing nip width is about 18 mm. The pressing pad 70 is prepared by integrally molding a supporting metal plate 70*a* of Fe and a silicone rubber elastic layer 70*b*. The elastic layer 70*b* of the pressing pad 70 contacts an inner peripheral surface (inner surface) of the belt 52. That is, the pressing bottom plate 61 is connected with the pressing arms 60 so that the belt 52 supported by the pressing arms 60 is pressed against and separated from the fixing roller 51 by being rotationally moved by the cam 64. The fixing nip separation means 80 is constituted so that the each of the pressing arms 60 is rotationally moved about the supporting shaft 63, as a supporting point, through the pressing bottom plate 61 by the rotation of the cam 64 as described later. Further, the fixing nip separation means 80 is constituted so that the magnitude of the spacing amount (distance) between the fixing roller 51 and the belt 52 can be variably set by moving the belt 52 from the position of the fixing nip N by the rotational movement of the respective pressing arms 60. As described above, when the fixing nip N is created by the fixing roller 51, the belt 52 and the pressing pad 70, the resultant fixing nip N can have a wider width so that the belt 52 is wound about the fixing roller 51 in the fixing nip N, which is advantageous in terms of speed-up. Further, in a conventional fixing device including a roller pair, the elastic layer was required to be made thick when the nip width was increased, so that the conventional fixing device was disadvantageous in terms of energy saving. On the other hand, in the fixing device 51 using the belt 52 as described above in this embodiment, it is possible to create the wide nip without increasing the thickness of the elastic layer 51*b* of the fixing roller 51 and thereby to prevent loss of heat transmission by the elastic layer 51*b*, so that the fixing device 51 is effective in saving energy.

On the upstream side of the fixing nip N with respect to the recording material conveying direction, an introducing guide 65 for guiding the recording material P to be conveyed into the fixing nip N is provided. The introducing guide 65 is supported by the side plate pair 14F1 at both of its longitudinal end portions so that the introducing guide 65 is movable from a recording material introducing position shown in FIG. 1B to a predetermined position, obliquely leftward below the recording material introducing position, shown in FIG. 3B. In the introducing guide moving mechanism 90, a tension spring (urging member) 67 is locked by the introducing guide 65 at one end thereof and is locked by either one portion of the side plate pair 14F1 at the other end, thus urging the introducing guide 65 toward the lower left direction. Then, the introducing guide 65 is caused to contact an introducing guide cam (introducing guide moving member) 76 having a substantially elliptical cross section, thus being kept at the recording material introducing position. The introducing guide cam 76 is supported by a cam shaft 76*a* provided on the side plate pair 14F1. The distance between a fixing nip N-side end of the introducing guide 65 kept at the recording material introducing position and the other peripheral surface of the fixing roller 51 at a portion closest to the end of the introducing guide 65 is set at about 5 mm. On the downstream side of the fixing nip N with respect to the recording material conveying direction, the discharging guide 66 for guiding the recording material P to be discharged from the fixing nip N is provided. The discharging guide 66 is rotationally movable from a recording material discharging position shown in FIG. 1B to a predetermined position, obliquely rightward below the recording material discharging position, shown in FIG. 3B. That is, the discharging guide 66 is supported so that both longitudinal end portions of a downstream-side end portion 66*a* of the discharging guide 65 with respect to the recording material conveying direction (hereinafter referred to as one end portion) are supported by the side plate pair 14F1 in the above-described rotationally movable manner. In the discharging guide moving mechanism 100, a tension spring (urging member) 68 is locked by the discharging guide 66 at one end thereof and is locked by either one portion of the side plate pair 14F1 at the other end, thus urging the discharging guide 66 the lower right direction. Then, the discharging guide 66 is caused to contact a discharging guide cam (discharging guide moving member) 77 having a substantially elliptical cross section, thus being kept at the recording material discharging position. The discharging guide cam 77 is supported by a cam shaft 77*a* provided on the side plate pair 14F1. The distance between a fixing nip N-side end of the discharging guide 66 kept at the recording material discharging position and the other peripheral surface of the fixing roller 51 at a portion closest to the end of the discharging guide 66 is set at about 3 mm.

In FIG. 1B, a reference numeral 74 represents a fixing discharging roller and a reference numeral 75 represents a winding-preventing member.

A method of detecting a jam occurring in the fixing device 14 will be described. In this embodiment, the jam occurrence is judged by a control circuit (control means) 141 on the basis of recording material presence-absence detecting signals (output signals) from an introduction-side recording material detecting portion 143 and a discharge-side recording material detecting portion 145, which are a recording material detecting portion. The control circuit 141 is constituted by a CPU and memories such as an ROM and an RAM. In the memories, various programs for controlling the entire image forming apparatus are stored. As the introduction-side recording material detecting portion 143 and the discharge-side recording material detecting portion 145, means for detecting the presence or absence of the recording material by pushing down a flapper by the weight of the recording material to block an optical axis of a transmission photo-interception sensor (not shown) and by measuring a change in light amount as an electric signal was used. The control circuit 141 monitors, on the basis of a setting size of the recording material with respect to the recording material conveying direction and the process speed, the time from detecting of the leading end of the recording material P by the introduction-side recording material detecting portion 143 to the detection of the trailing end of the recording material P by the discharge-side recording material detecting portion 145. The control circuit 141 determines that the conveyance of the recording material P is normal when the leading and trailing end of the recording material P pass between the introduction-side recording material detecting portion 143 and the discharge-side recording material detecting portion 145 with a predetermined timing, and determines that a fixing jam occurs when the leading and trailing ends of the recording material P do not pass between the detecting portions 143 and 145 with the predetermined timing. In this embodiment, as a determination pattern for the fixing jam, three patterns consisting of an upstream fixing jam, a winding jam, and a discharge-side accordion fixing jam are set. The fixing jam is determined to be the upstream fixing jam when the leading end of the recording material P does not reach the discharge-side recording material detecting portion (means) 145 within a normal timing, although it has normally passed through the introduction-side recording material detecting portion (means) 143. In the case of the upstream fixing jam, the recording material P causes the jam at an upstream-side position of the fixing nip N with respect to the recording material conveying direction. The fixing jam is determined to be the winding jam when the leading end of the recording material P does not reach the discharge-side recording material detecting portion 145 with the normal, timing although it has normally passed through the introduction-side recording material detecting portion 143. In the case of the winding jam, the recording material P is wound about the surface of the fixing roller 51 to cause the jam. The fixing jam is determined to be the accordion fixing jam when the trailing end of the recording material P has passed through the introduction-side recording material detecting portion 143 but thereafter does not reach the discharge-side recording material detecting portion 145 within the normal timing, although the leading end of the recording material P has normally passed through the introduction-side recording material detecting portion 143 and the discharge-side recording material detecting portion 145. In the case of the accordion jam, the recording material P causes the jam at a downstream-side position of the fixing nip N with respect to the recording material conveying direction. In the case where the control circuit 141 determines that the fixing jam occurs, the control circuit 141 stops the operation of the image forming portions and the fixing device 14 in accordance with a fixing nip separation control program due to an emergency. Then, the control circuit 141 displays information indicating the occurrence of the jam, the position of the jam occurrence, and a method of jam clearance at a display portion (not shown) of the image forming apparatus, thus urging a user to perform jam clearance. At the same time, the control circuit 141 effects rotation control of the cam 64 so that the spacing amount (distance) between the fixing roller 51 and the belt 52 equals to a second spacing amount larger than a first spacing amount described later. Further, the control circuit 141 effects the rotation control of the introducing guide cam 76 so that the introducing guide 65 is moved to a predetermined position spaced apart farther from the fixing roller 51 than the recording material introducing position. Further, the control circuit 141 effects the rotation control of the discharging guide cam 77 so that the discharging guide 66 is moved to a predetermined position spaced apart farther from the fixing roller 51 than the recording material discharging position.

Figure 2:
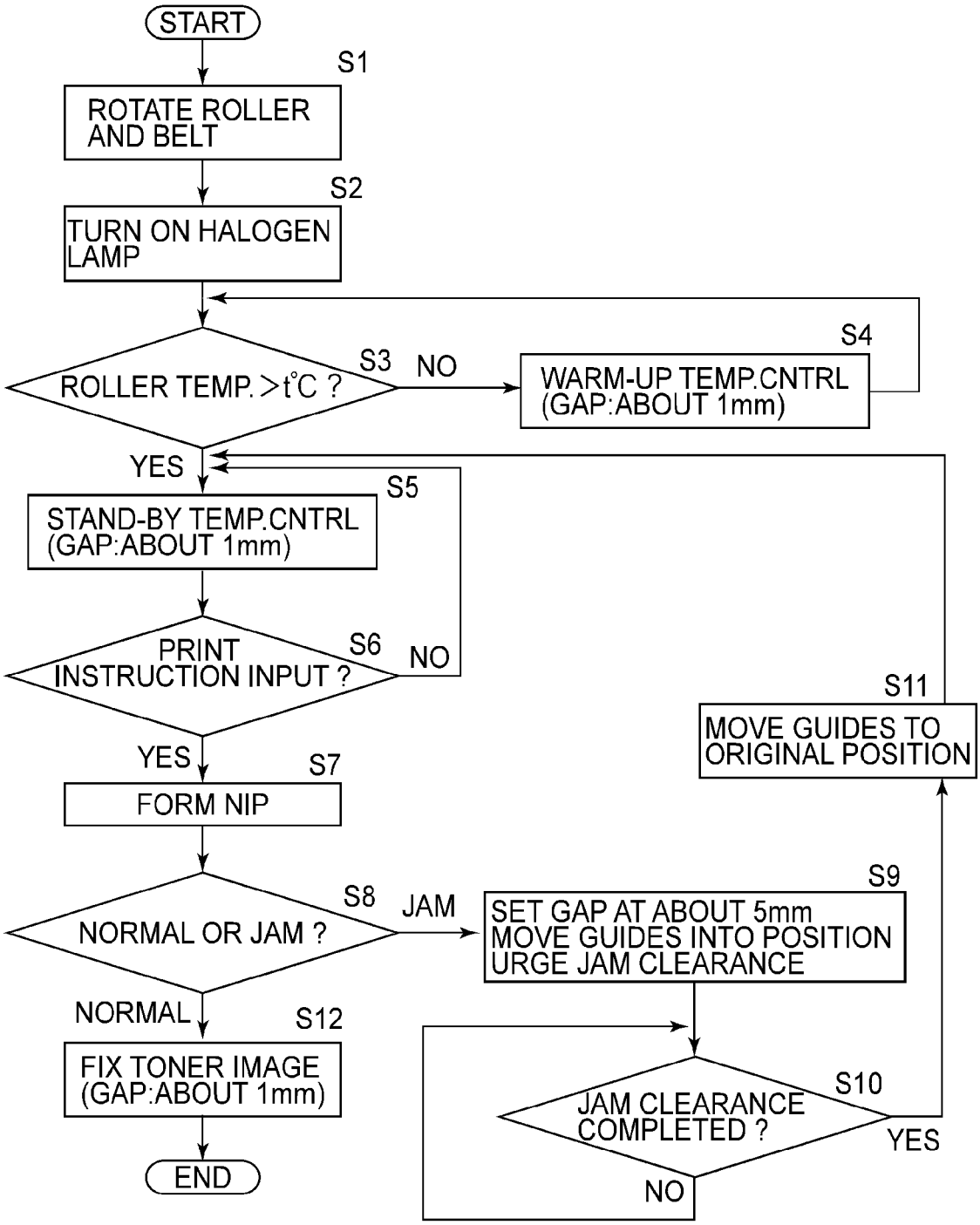
FIG. 2 is a flow chart for illustrating, as an example, a heat-fixing operation of the fixing device and a separating operation in the fixing nip during an occurrence of fixing jam in Embodiment 1.
Figure 3A:
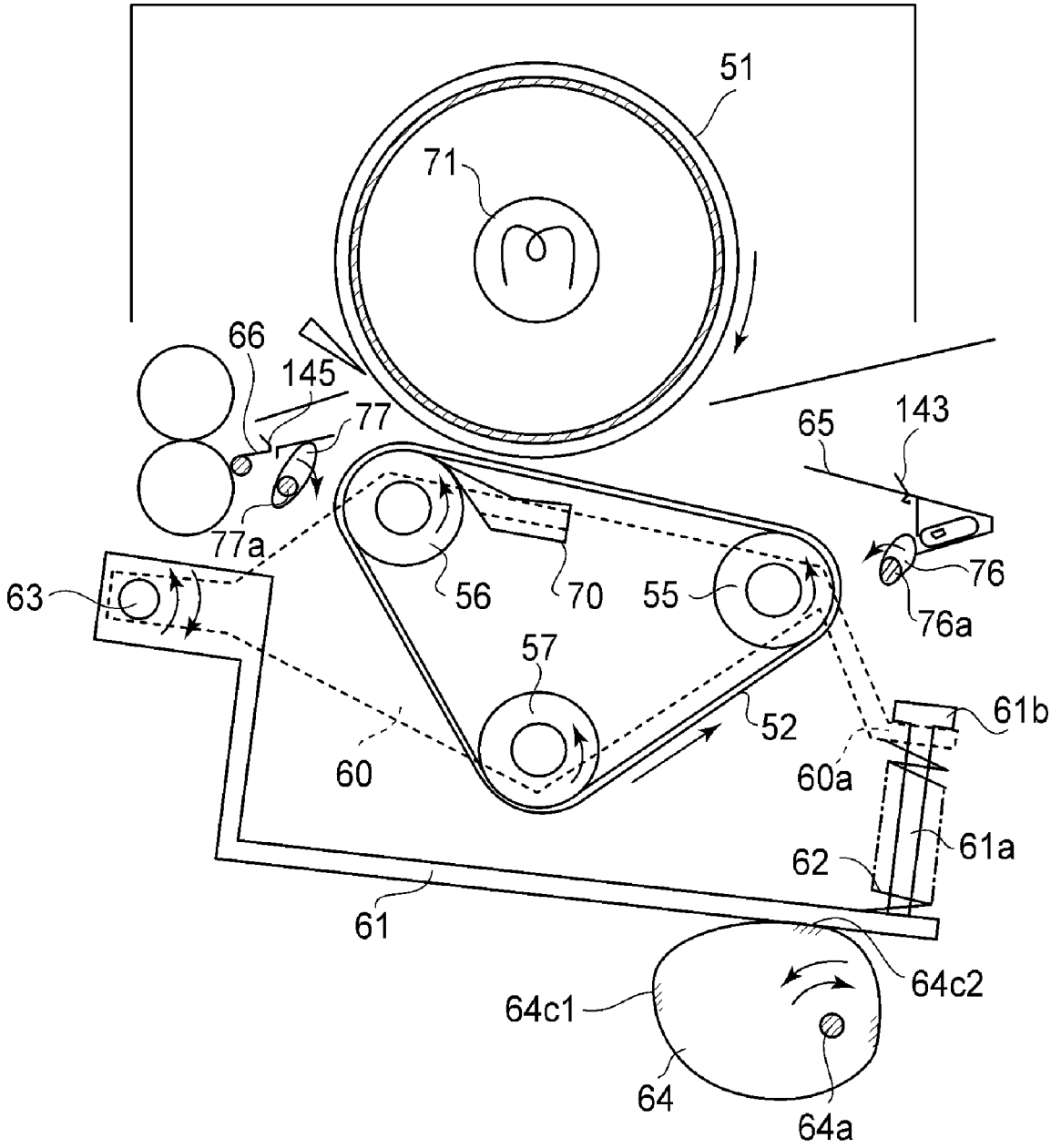
FIG. 3A is a schematic view for illustrating a state in which a spacing amount (distance) between a fixing roller and an endless belt of the fixing device in Embodiment 1 is set at a first spacing amount.
Figure 3B:
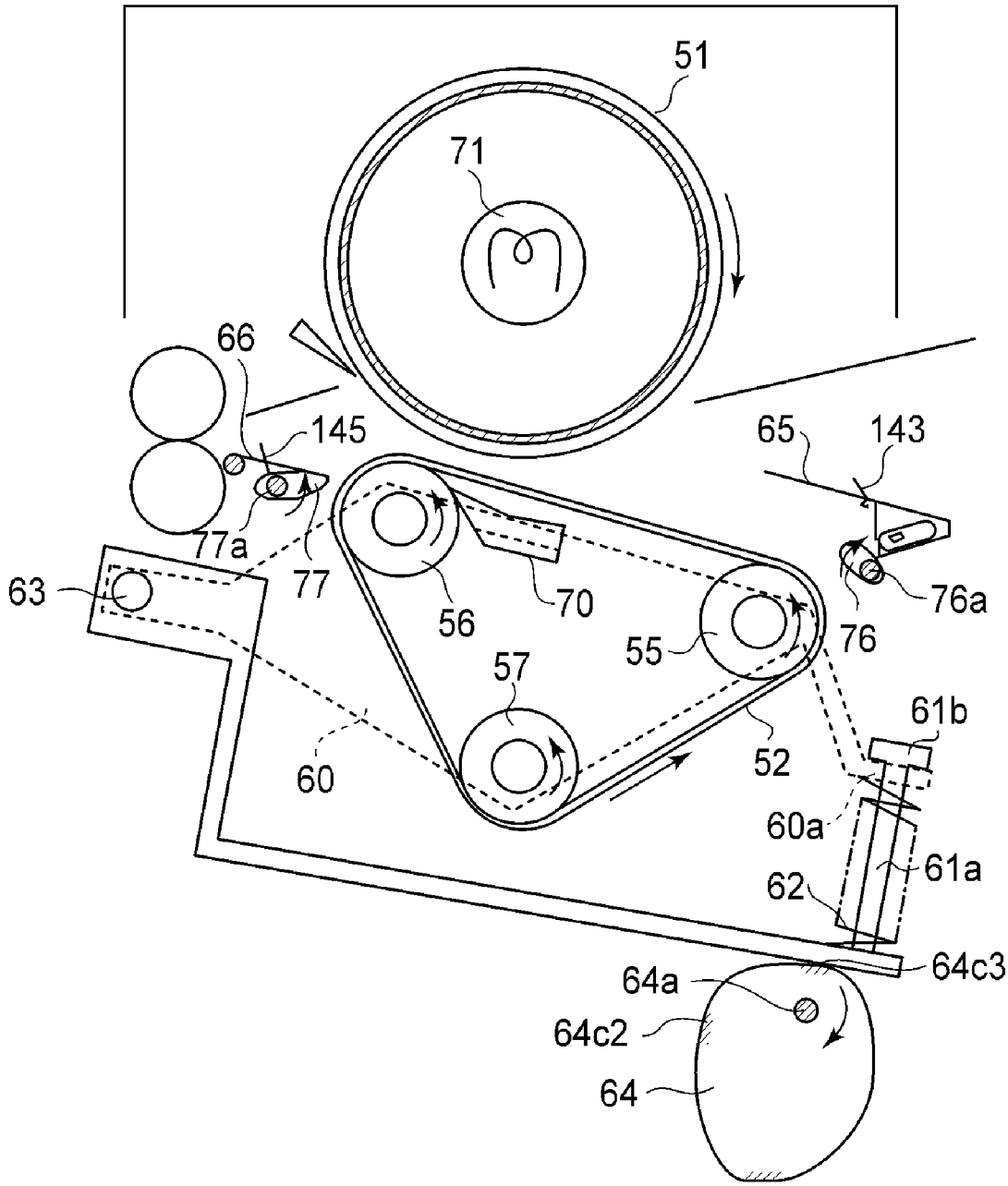
FIG. 3B is a schematic view for illustrating a state in which the spacing amount between the fixing roller and the endless belt of the fixing device in Embodiment 1 is set at a second spacing amount and in which an introducing guide and a discharging guide are moved to their predetermined positions.

(3) Heat-Fixing Operation of Fixing Device and Fixing Nip Separation Operation During Fixing Jam Occurrence FIG. 2 is a flow chart for illustrating, as an example, a heat-fixing operation of the fixing device and a separating operation in the fixing nip during an occurrence of fixing jam in this embodiment. FIG. 3A is a schematic view for illustrating a state in which the spacing amount between a fixing roller and an endless belt of the fixing device in this embodiment is set at the first spacing amount, and FIG. 3B is a schematic view for illustrating a state in which the spacing amount between the fixing roller and the endless belt of the fixing device in this embodiment is set at the second spacing amount and in which an introducing guide and a discharging guide are moved to their predetermined positions. The procedure along the flow chart shown in FIG. 2 is started by turning on the power of the image forming apparatus. Then, the control circuit 141 controls the heat-fixing operation of the fixing device 14 and the fixing nip separation operation during the fixing jam occurrence.

Referring to FIG. 2, in step S1, the rotations of the fixing roller 51 and the belt 52 are started. That is, a fixing motor M1 is driven to rotate the roller 56 in the arrow direction (FIG. 1B). As a result, by the rotation of the roller 56, the belt 52 and the rollers 55 and 57 are rotated in the arrow directions at a predetermined peripheral speed (process speed). A force of the rotation of the belt 52 is transmitted to the fixing roller 51 by a frictional force between the surfaces of the belt 52 and the fixing roller 51. As a result, the fixing roller 51 is rotated in the arrow direction by the rotation of the belt 52.

In step S2, energization (power supply) to the lamp 71 is started. That is, an energization circuit 142 is turned on to supply the power to the lamp 71. As a result, the lamp 71 is turned on and generates heat, thus heating the cylindrical metal core 51*a*, elastic layer 51*b* and parting layer 51*c* of the fixing roller 51. In step S3, whether or not a temperature of the fixing roller 51 reaches a predetermined temperature t ° C. to be controlled (target temperature) (170° C. in this embodiment) is determined The temperature of the fixing roller 51 is detected by a thermistor TH (temperature detecting member) disposed in the neighborhood of the surface of the fixing roller 51. The control circuit 141 obtains a temperature detecting signal (output signal) of the thermistor TH and determines whether or not the temperature of the fixing roller 51 reaches the predetermined temperature (target temperature) t ° C. on the basis of the temperature detection signal.

In step S3, in the case where the temperature of the fixing roller 51 does not reach the predetermined temperature t ° C. to be controlled ("NO"), the procedure goes to step S4. In the case where the temperature reaches the predetermined temperature t ° C. to be controlled ("YES"), the procedure goes to step S5.

In step S4, warm-up temperature control is effected by continuing the turning-on of the energization circuit 142 until the temperature of the fixing roller 51 reaches the predetermined temperature t ° C. to be controlled. Further, the spacing amount between the fixing roller 51 and the belt 52 is set at about 1 mm (the first spacing amount) (FIG. 3A). That is, in the state of FIG. 1B in which the fixing nip N is created between the fixing roller 51 and the belt 52, a cam motor M2 is driven to rotate the cam 64 about the cam shaft 64*a* as the supporting point in the arrow direction until the second cam surface 64*c*2 contacts the pressing bottom plate 61. The second cam surface 64*c*2 has the second largest distance, from the cam shaft 64*a*, next to the first cam surface 64*c*1. Correspondingly to the rotation of the cam 64, the pressing bottom plate 61 is rotated about the supporting shaft 63 as the supporting point in the arrow direction by a difference in distance from the cam shaft 64*a* between the first cam surface 64*c*1 and the second cam surface 64*c*2. By the rotational movement of the pressing bottom plate 61, the spring receiving portion 60*c* of each of the pressing arms 60 contacts the stopper 61*b* of each of the spring holding portions 61*a* of the pressing bottom plate 61, so that each of the pressing arms 60 is rotationally moved about the supporting shaft 63 as the supporting point in the arrow direction while keeping the contact state. By the rotational movements of the pressing bottom plate 61 and the respective pressing arms 60, the belt 52 is selected (spaced) from the surface of the fixing roller 51 by a predetermined distance. The spacing amount between the surfaces of the belt 52 and the fixing roller 51 at this time is about 1 mm. In this embodiment, during the warm-up temperature control, the fixing roller 51 and the belt 52 are rotated but the warm-up temperature control may also be effected until the fixing roller temperature reaches the predetermined temperature, from the viewpoint of durability, in the state in which the portions of the fixing roller 51 and the belt 52 are stopped.

In step S5, stand-by temperature control is effected by performing ON/OFF control of the energization circuit 142 so that the temperature of the fixing roller 51 is kept at the predetermined temperature t ° C. to be controlled in the stand-by state in which the image forming apparatus is ready for the input of the print signal as the image forming signal. Further, similarly as in step S4, the spacing amount between the fixing roller 51 and the belt 52 is set at about 1 mm (FIG. 3A). That is, in step S4 and step S5, before the recording material P is introduced into the fixing nip N (during the stand-by), the spacing amount between the fixing roller 51 and the belt 52 is set at about 1 mm. The reason why the spacing amount in this embodiment is set at about 1 mm is that a first copy time (from the input of the print instructions image forming signal) to the output of the first point) can be minimized when the spacing amount is not more than 2 mm from a result of an experiment. Also during the stand-by temperature control, the spacing amount is kept at 1 mm. Further, the introducing guide 65 is kept at the recording material introducing position and the discharging guide 66 is ready for a subsequent operation while being kept at the recording material discharging position.

Incidentally, in this embodiment, the image forming apparatus has a constitution in which the fixing roller 51 and the belt 52 are separated in the stand-by state but may also have a constitution employing the stand-by state in which the fixing roller 51 and the belt 52 are separated and a stand-by state in which the fixing roller 51 and the belt 52 contact each other.

In step S6, in the case where the print instructions are input ("YES"), the procedure goes to step S7. In step S7, the fixing nip N is created (FIG. 1B). That is, the cam motor M2 is driven to rotate the cam 64 about the cam shaft as the supporting point in the arrow direction until the first cam surface 64*c*1 contacts the pressing bottom plate 61 (FIG. 3A). Correspondingly to the rotation of the cam 64, the pressing bottom plate 61 is rotated about the supporting shaft 63 as the supporting point in the arrow direction by a difference in distance from the cam shaft 64*a* between the first cam surface 64*c*1 and the second cam surface 64*c*2. By the rotational movement of the pressing bottom plate 61, the spring receiving portion 60*c* of each of the pressing arms 60 contacts the stopper 61*b* of each of the spring holding portions 61*a* of the pressing bottom plate 61, so that each of the pressing arms 60 is rotationally moved about the supporting shaft 63 as the supporting point in the arrow direction by a predetermined distance while keeping the contact state. By the rotational movement of the respective pressing arms 60, the belt 52 contacts the fixing roller 51 and thereafter is pressed against the surface of the fixing roller 51 by the roller 56 and the pressing pad 70, so that the rotational movement of the respective pressing arms 60 is stopped. By further rotational movement of the pressing bottom plate 61, the spring receiving portion 60*a* of each of the pressing arms 60 is separated from the stopper 61*b* of each of the spring holding portions 61*a*. As a result, the pressing spring 62 presses the roller 56 and the pressing pad 70 so as to press the belt 52 against the surface of the fixing roller 51. As a result, the fixing nip N having a predetermined width is created between the fixing roller 51 surface and the belt 52 surface. Then, the recording material P carrying thereon the unfixed full-color toner image to be conveyed into the fixing nip N is guided by the introducing guide 65 and is introduced into the fixing nip N.

In this embodiment, the operations of the image forming portions and the conveyance of the recording material are started after the print instructions are received by the control circuit. Then, the rotation operation of the cam is started with predetermined timing obtained by back-calculation from the time required for the recording material carrying the unfixed toner image to reach the fixing device and the pressing operation time of the belt in the fixing device. In this embodiment, the pressing operation time of the belt required from the state of the spacing amount at 1 mm to the creation of the normal fixing nip is 2.5 seconds shorter than 3.8 seconds, which is the time required for the recording material to reach the fixing device after the image forming operation is started. Therefore, the first copy time is not adversely affected.

In step S8, a determination whether the conveyance of the recording material P is normal or causes the fixing jam occurrence is made. In the case of the determination that the fixing jam occurs, the procedure goes to step S9. In the case where the conveyance of the recording material P is normal, the procedure goes to step S11.

In step S9, the spacing amount is set at about 5 mm, and the introducing guide 65 and the discharging guide 66 are moved to their predetermined positions, respectively. That is, in the state of FIG. 3A in which the spacing amount is set at about 1 mm, the cam motor M2 is driven to rotate the cam 64 about the cam shaft 64*a* as the supporting point in the arrow direction until the third cam surface 64*c*3 contacts the pressing bottom plate 61 (FIG. 3B). The third cam surface 64*c*3 has the smallest distance from the cam shaft 64*a*. Correspondingly to the rotation of the cam 64, the pressing bottom plate 61 is rotated about the supporting shaft 63 as the supporting point in the arrow direction by a difference in distance from the cam shaft 64*a* between the third cam surface 64*c*3 and the second cam surface 64*c*2. By the rotational movement of the pressing bottom plate 61, the spring receiving portion 60*c* of each of the pressing arms 60 contacts the stopper 61*b* of each of the spring holding portions 61*a* of the pressing bottom plate 61, so that each of the pressing arms 60 is rotationally moved about the supporting shaft 63 as the supporting point in the arrow direction while keeping the contact state. By the rotational movements of the pressing bottom plate 61 and the respective pressing arms 60, the belt 52 is selected (spaced) from the surface of the fixing roller 51 by a predetermined distance. The spacing amount (second spacing amount) between the surfaces of the belt 52 and the fixing roller 51 at this time is about 5 mm larger than the first spacing amount. Further, an introducing guide motor M3 is driven, whereby the introducing guide cam 76 is rotated about the cam shaft 76*a* as the supporting point in the arrow direction by a predetermined angle (FIG. 3A). As a result, the introducing guide cam 76 is moved from the recording material introducing position (image formation position) to a retraction position retracted from the recording material introducing position and is stopped. The distance from the fixing nip N-side end of the introducing guide 65 stopped at the retraction position to the outer peripheral surface of the fixing roller 51 at the position closest to the end of the introducing guide 65 is set at about 10 mm. At the same time, a discharging guide motor M4 is driven, whereby the discharging guide cam 77 is rotated about the cam shaft 77*a* as the supporting point in the arrow direction by a predetermined angle (FIG. 3A). As a result, the discharging guide cam 77 is moved from the recording material discharging position (image formation position) to a retraction position retracted from the recording material discharging position and is stopped. The distance from the fixing nip N-side end of the discharging guide 66 stopped at the retraction position to the outer peripheral surface of the fixing roller 51 at the position closest to the end of the discharging guide 66 is set at about 8 mm. In this embodiment, in order to move the introducing guide 65 to the retraction position spaced farther apart from the fixing roller 51 than the recording material introducing position, the introducing guide 65 is moved from the recording material introducing position to a lower left position by the rotation of the introducing guide cam 76. Further, in order to move the discharging guide 66 to the retraction position spaced farther apart from the fixing roller 51 than the recording material discharging position, the discharging guide 66 is moved from the recording material discharging position to a lower right position by the rotation of the discharging guide cam 77. Here, the distance from the end of the introducing guide 65 to the fixing roller 51 during the image formation is smaller than that at the time when the introducing guide 65 is located at the retraction position. Further, the distance from the end of the discharging guide 66 to the fixing roller 51 during the image formation is smaller than that at the time when the discharging guide 66 is located at the retraction position. Further, information for urging the user to perform the jam clearance is displayed at the display portion (not shown) of the image forming apparatus, and these guides 65 and 66 are ready for their subsequent operations.

In accordance with the urge, the user opens another casing cover (not shown) provided at a periphery of the fixing device 14 in the image forming apparatus and pulls out a conveying unit (not shown) including the fixing device to the outside of the image forming apparatus, thus removing the recording material causing the jam (hereinafter referred to as jammed paper). At this time, the fixing roller 51 and the belt 52 are largely separated from each other, so that the surface of the fixing roller 51 is less damaged by the jammed paper. It is desirable that the fixing roller 51 and the belt 52 are separated with a distance not less than a vertical spatial distance at a conveyance portion through which the recording material P is to be passed, i.e., a conveyance space portion between the discharging guide 66 and an auxiliary discharging guide 69 disposed above the discharging guide 66 (FIG. 1B). As a result, the fixing roller 51 and the belt 52 are separated with a distance not less than the thickness (height) of the jammed paper during the occurrence of the accordion jam and therefore it is possible to perform the jam clearance efficiently.

In this embodiment, the vertical spatial distance at the conveyance portion is about 4 mm, and the spacing amount (distance) between the fixing roller 51 and the belt 52 at the time of performing the jam clearance is set at about 5 mm. As a result, it was confirmed that the jammed paper did not strongly contact the surface of the fixing roller 51 and therefore the jam clearance was capable of being smoothly performed. Further, the introducing guide 65 and the discharging guide 66 may also be moved to positions in which they can protect the fixing roller 51. When the fixing roller 51 is protected by the introducing guide 65 and the discharging guide 66, it is possible to reduce a possibility of contact of the jammed paper with the fixing roller 51 surface when the user performs the jam clearance, so that the damage of the fixing roller 51 surface can be obviated.

In step S10, whether or not the jam clearance is completed is determined. That is, after the user completes the jam clearance, the user mounts the conveying unit in the image forming apparatus and then closes the outer casing cover to return the state of the conveying unit to the original state. Then, on the basis of predetermined information from the introduction-side recording material detecting portion 143 and the discharge-side recording material detecting portion 145, the control circuit 141 determines that the jam clearance is completed. When the jam clearance is completed, the procedure goes to S11.

In step S11, the introducing guide motor M3 is driven, so that the introducing guide cam 76 is rotated in the arrow direction by a predetermined angle (FIG. 3B). As a result, the introducing guide 65 is moved from the predetermined position to the original recording material conveying position and is stopped at the conveying position. At the same time, the discharging guide motor M4 is driven, so that the discharging guide cam 77 is rotated in the arrow direction by a predetermined angle (FIG. 3B). As a result, the discharging guide 66 is moved from the predetermined position to the original recording material discharging position and is stopped at the discharging position. After the movement of the introducing guide 65 and the discharging guide 66 to their original positions is completed, the procedure is returned to step S5. In this case, the procedure may also be returned to step S5 after an unshown recovery sequence from jam is executed in order to return the states of the fixing device and the image forming portions to their stand-by states. During the recovery sequence, the distance between the fixing roller 51 and the belt 52 equals to that during the separation. With this distance, a restoring operation (recovery operation) is performed.

In step S12, the heat-fixing of the toner image is performed. The recording material P introduced into the fixing nip N by the introducing guide 65 is nipped and conveyed by the fixing roller 51 and the belt 52 in the fixing nip N. During the conveying process, the toner image is subjected to heat by the fixing roller 51 and pressure in the fixing nip N, thus being heat-fixed on the recording material P. Then, after the trailing end of the recording material P discharged through the discharging guide 66 normally passes through the discharge-side recording material detecting means 145, the spacing amount is set at about 1 mm. That is, the cam motor M2 is driven in accordance with the detection signal from the discharge-side detecting means to rotate the cam 64 in the arrow direction so that the second cam surface 64*c*2 of the cam 64 contacts the pressing bottom plate 61. As a result, the spacing amount is set at about 1 mm. As a result, a series of the heat-fixing operations of the fixing device 14 and the fixing nip separation operation during the fixing jam occurrence are completed.

According to the fixing device 14 in Embodiment 1, the fixing device 14 includes the fixing nip separation mechanism 80 for placing the fixing roller 51 and the belt 52 in a mutually separated state during the stand-by before the recording material P is conveyed into the fixing nip N and during the jam occurrence of the recording material P in the fixing nip N. By using the fixing nip separating mechanism 80, the distance between the fixing roller 51 and the belt 52 during the jam occurrence is set at a value longer than that during the stand-by. For that reason, it is possible to easily perform the jam clearance while decreasing the time required for returning the state of the fixing device to the state in which the heat-fixing operation (heating operation) can be performed. Further, the spacing amount is set at about 1 mm before the recording material P carrying the toner image T is introduced into the fixing nip N and after the recording material P is discharged out of the fixing nip N, so that improvement in durability of the fixing roller 51 and the belt 52 can be realized. Further, the spacing amount is set at about 5 mm when the jam clearance of the recording material P is performed, so that improvement in operability of the jam clearance operation can be realized. Further, the introducing guide 65 and the discharging guide 66 are moved to the predetermined positions when the jam clearance of the recording material P is performed, so that the improvement in operability of the jam clearance operation can be realized.

Embodiment 2

Figure 4A:
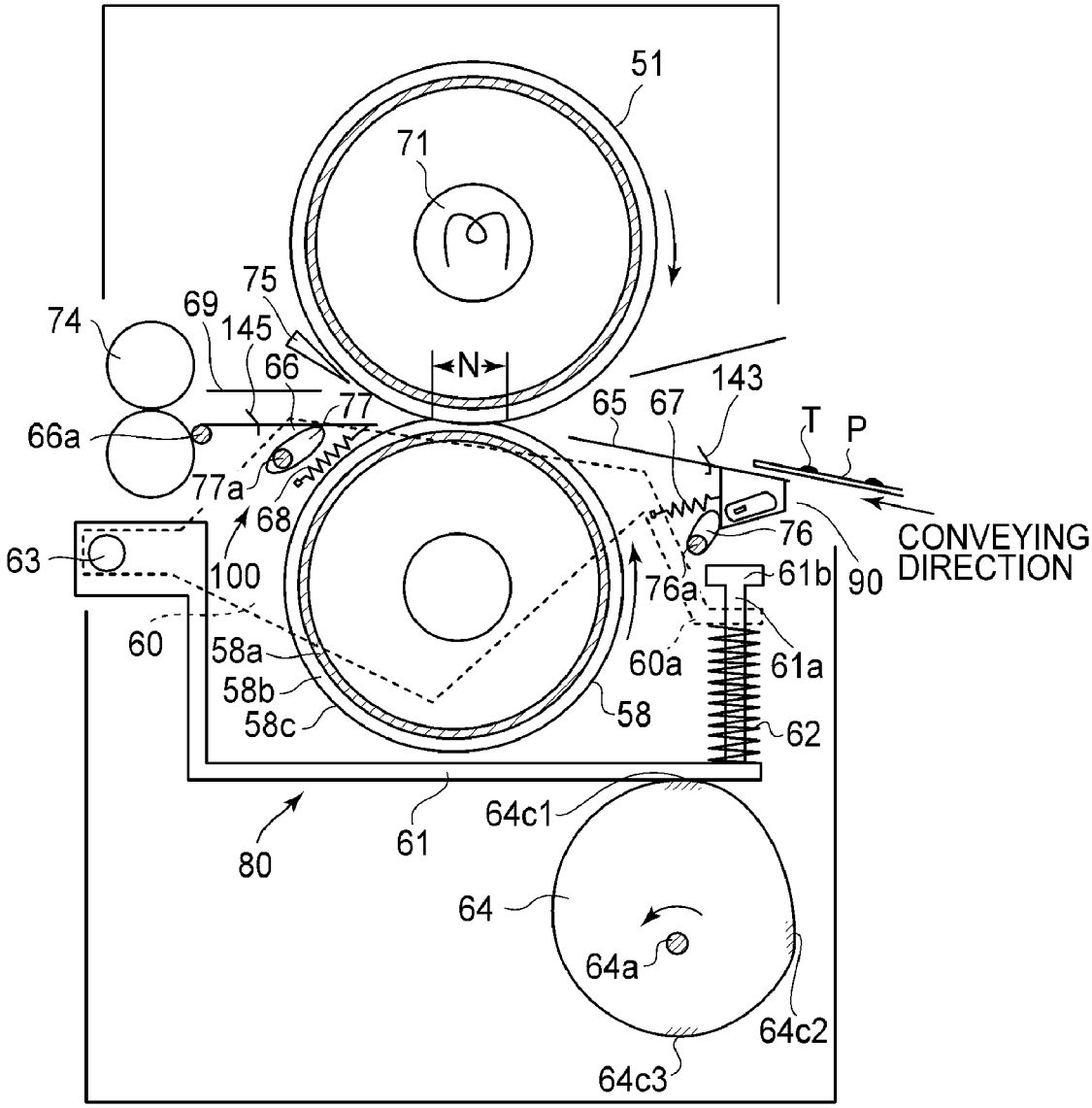
FIG. 4A is a schematic cross-sectional view of a fixing device in Embodiment 2 and shows a state in which a fixing nip is formed.

Another embodiment of the fixing device will be described. FIG. 4A is a schematic cross-sectional view of the fixing device in this embodiment and shows a state in which the fixing nip is created. This fixing device is of a roller type.

The fixing device in this embodiment has the same constitution as that of the fixing device 14 in Embodiment 1 except that a pressing roller (pressing member) 58 having the substantially same diameter as that of the fixing roller 51 is supported by the pressing arms 60.

In this embodiment, members and portions identical to those for the fixing device 14 in Embodiment 1 are represented by the same reference numerals or symbols as those in Embodiment 1, and thus, a description thereof is omitted. Incidentally, in this embodiment, as the fixing roller 51, a fixing roller including the elastic layer 51*b* formed in a thickness larger than that of the elastic layer 51*b* in the fixing roller 51 in Embodiment 1. That is, the fixing roller 51 in this embodiment is prepared by forming a 4.0 mm-thick silicone rubber elastic layer 51*b* on the outer peripheral surface of the cylindrical metal core 51*a* of Fe having the outer diameter of 72 mm. On the outer peripheral surface of the elastic layer 51*b*, the 30 μm-thick PFA tube is coated as the parting layer 51*c*.

The pressing roller 58 is prepared by forming, in a roller shape, a 2.0 mm-thick silicone rubber elastic layer 58*b* on the outer peripheral surface of a cylindrical metal core 58*a* of Fe having the outer diameter of 76 mm. Then, on the outer peripheral surface of the elastic layer 58*b*, a 30 μm-thick PFA tube is coated as a parting layer 58*c*. The pressing roller 58 is rotatably supported by the side plate pair 14F1 of the device frame 14F of the fixing device 14 at the both longitudinal end portions of the cylindrical metal core 58*a* thereof. The pressing roller 58 is pressed against the surface of the fixing roller 51 at a total pressure of about 490N (about 50 kgf) by the pressing spring 62 provided below the spring receiving portion 60*a* of each of the pressing arms 60 at each of the spring holding portions 61*a* of the pressing bottom plate 61. As a result, the elastic layers 51*b* and 58*b* of the fixing roller 51 and the pressing roller 58 are elastically deformed, so that the fixing nip N is created with the predetermined width between the surfaces of the fixing roller 51 and the pressing roller 58. The predetermined width of the fixing nip N is about 10 mm. The pressing roller 58 is rotated in the arrow direction at a predetermined peripheral speed by rotating the cylindrical metal core 58*a* thereof by the drive of the fixing motor M1. The rotational force of the pressing roller 58 is transmitted to the surface of the fixing roller 51 by the frictional force between the surfaces of the fixing roller 51 and the pressing roller 58 in the fixing nip N. As a result, the fixing roller 51 is rotated in the arrow direction by the rotation of the pressing roller 58.

In the fixing device 14 in this embodiment, the heat-fixing operation and the fixing nip separation operation (fixing nip removing operation) during the fixing jam occurrence are identical to those in the fixing device 14 in Embodiment 1, thus being described along the flow chart of FIG. 2 for simple explanation.

Figure 4B:
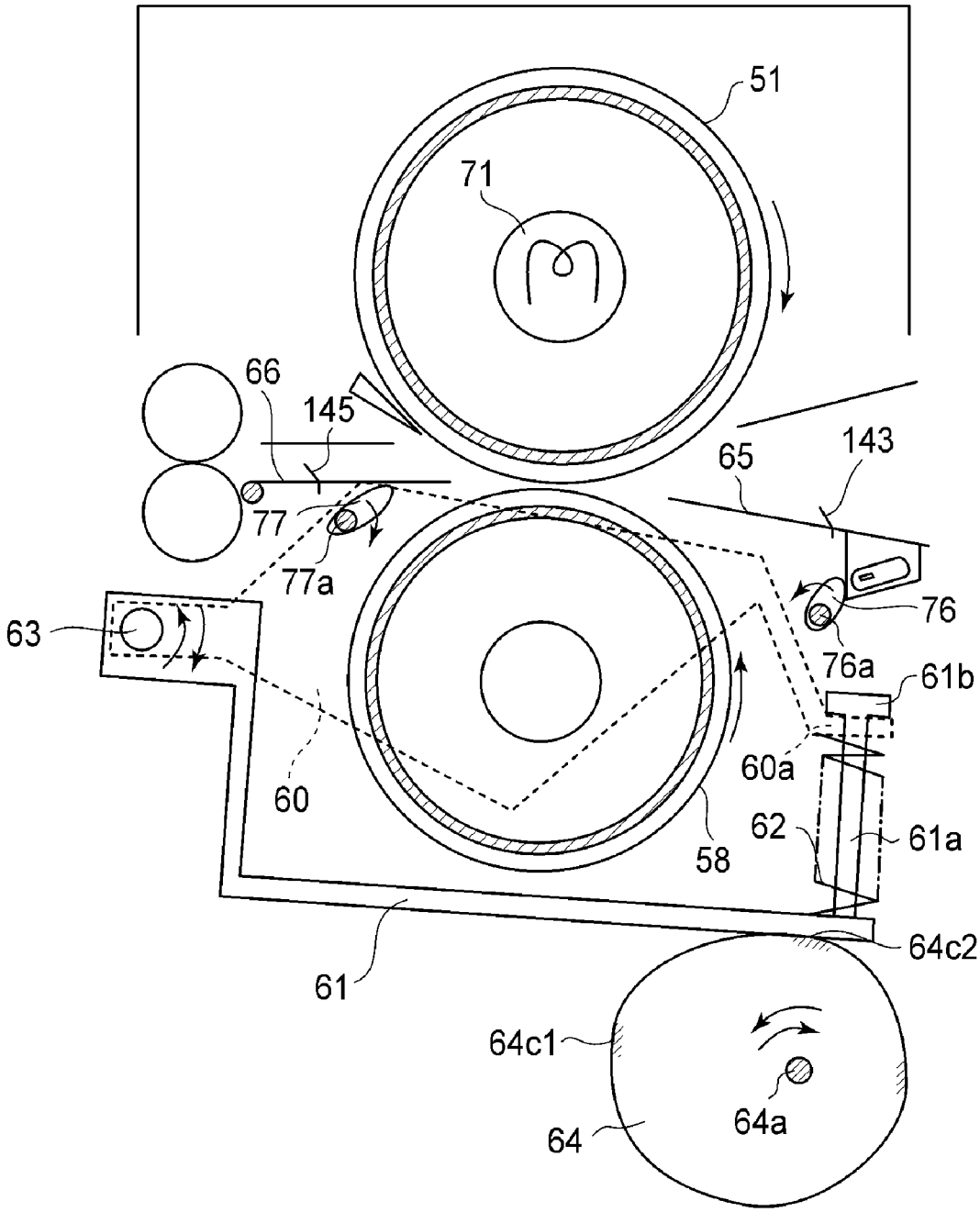
FIG. 4B is a schematic view for illustrating a state in which a spacing amount between a fixing roller and a pressing roller of the fixing device in Embodiment 2 is set at a first spacing amount.
Figure 4C:
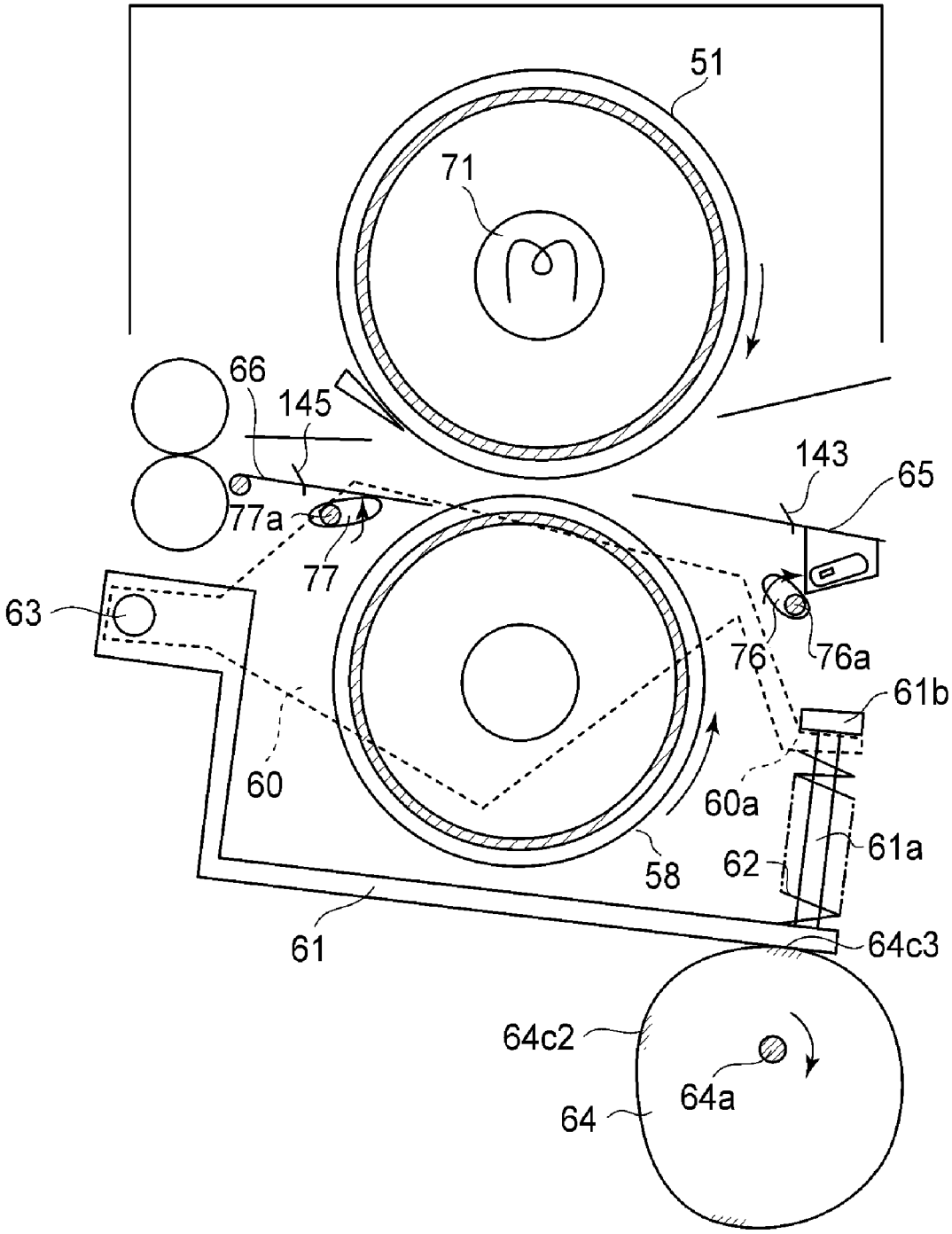
FIG. 4C is a schematic view for illustrating a state in which the spacing amount between the fixing roller and the pressing roller of the fixing device in Embodiment 2 is set at a second spacing amount and in which an introducing guide and a discharging guide are moved to their predetermined positions.

FIG. 4B is a schematic view for illustrating a state in which the spacing amount between a fixing roller and a pressing roller of the fixing device in this embodiment is set at a first spacing amount, and FIG. 4C is a schematic view for illustrating a state in which the spacing amount between the fixing roller and the pressing roller of the fixing device in this embodiment is set at a second spacing amount and in which an introducing guide and a discharging guide are moved to their predetermined positions.

In the fixing device 14 in this embodiment, the fixing nip N is created by the fixing roller 51 and the pressing roller 58, so that the wider fixing nip as in the belt-type fixing device cannot be created. However, in the fixing device 14 in this embodiment, the pressing roller 58 has greater strength and therefore it is possible to apply a higher pressing force as contact pressure, so that the fixing device 14 in this embodiment can achieve speed-up with a simple constitution. Generally, the above constitution is employed in a monochromatic image forming apparatus in many cases.

Also in the fixing device 14 in Embodiment 2, with respect to the pressing roller 58, a separating operation identical to the belt separating operation as shown in the flow chart of FIG. 2 was performed. As a result, it was confirmed that the functional effect similar to that in Embodiment 1 was achieved.

In the fixing device 14 in this embodiment, in order to shorten the rise time of the fixing device 14, it is also possible to employ a constitution in which the halogen lamp is provided inside the cylindrical metal core 58*a* of the pressing roller 58 so as to heat the pressing roller 58.

Embodiment 3

Figure 5:
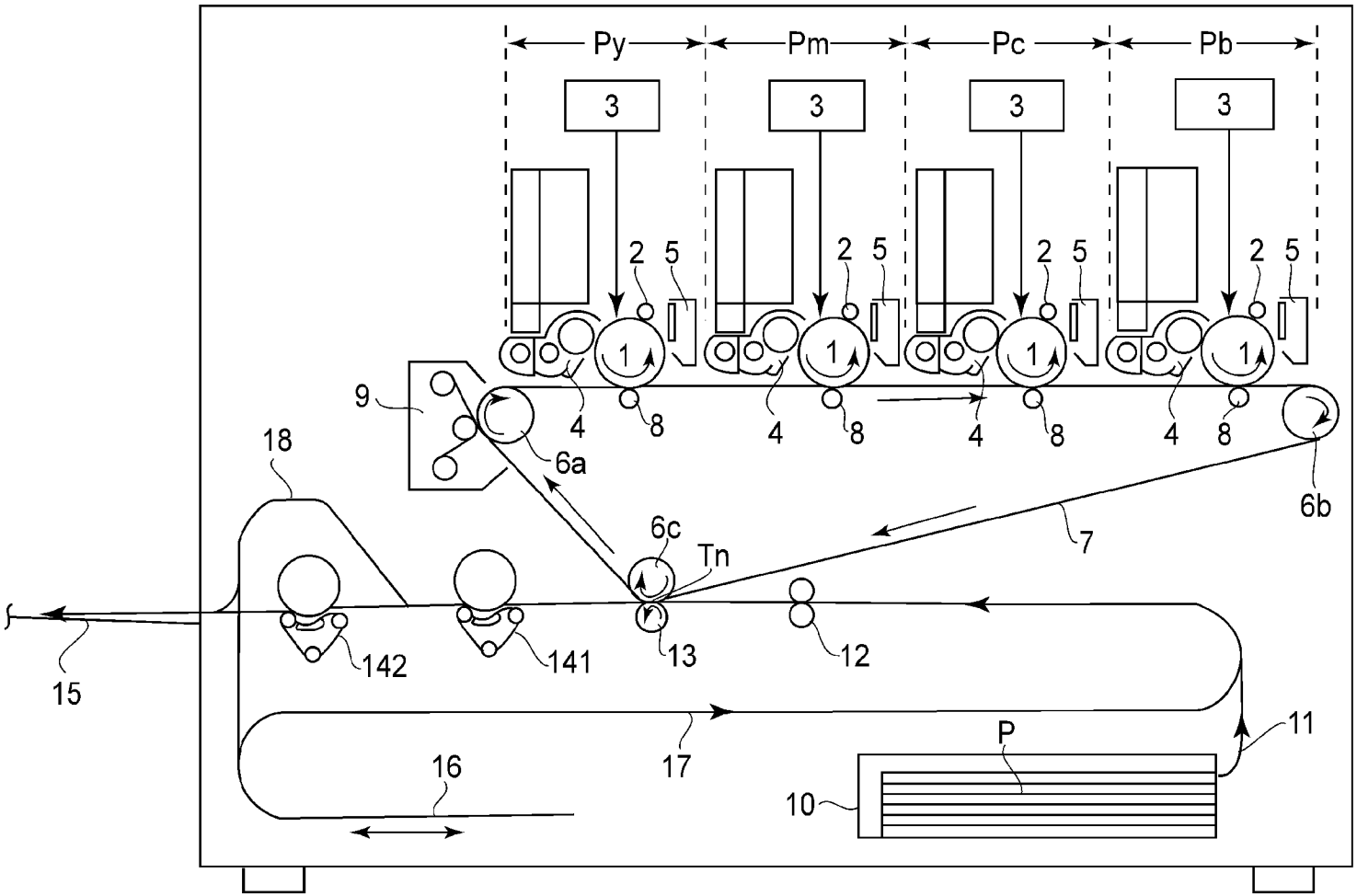
FIG. 5 is a schematic cross-sectional view of an image forming apparatus according to another embodiment.

Another embodiment of the image forming apparatus will be described. FIG. 5 is a schematic cross-sectional view showing an example of the image forming apparatus in this embodiment. This image forming apparatus is an electrophotographic color printer employing a so-called tandem type fixing scheme in which a plurality of fixing devices 14 are arranged in series at the recording material conveying portion.

The image forming apparatus in this embodiment has the same constitution as that of the image forming apparatus in Embodiment 1 except that two fixing devices 14 identical to the fixing device 14 in Embodiment 1 are arranged in series. In this embodiment, members and portions identical to those in the image forming apparatus in Embodiment 1 are represented by the same reference numerals or symbols as those for the image forming apparatus in Embodiment 1, and thus a description thereof is being omitted. In the image forming apparatus in this embodiment, each of the fixing devices 14 is not limited to the fixing device 14 in Embodiment 1 but may also be the fixing device 14 in Embodiment 2. Further, it is also possible to arrange the fixing device 14 in Embodiment 1 and the fixing device 14 in Embodiment in series at the recording material conveying portion.

According to the image forming apparatus in this embodiment, by employing the tandem type fixing scheme, it is possible to ensure a very side nip, so that high productivity can be maintained even with respect to the recording materials P having various basis weights. Further, by providing a conveying path 18 in which the recording material P does not pass through a downstream-side fixing device 14 (142) with respect to the recording material conveying direction, the image forming apparatus has such an advantage that wide selection latitude of glossiness of the output image can be ensured. On the other hand, particularly in the case where the both fixing devices 14 and 14 are close to each other, i.e., in the case where the both fixing devices 14 and 14 are disposed at an interval shorter than the maximum length of the recording material P with respect to the recording material conveying direction, the jam can occur in a state in which the recording material P is jammed in the fixing nips of the both fixing devices. For that reason, there arisen a problem that it was very difficult to perform the operation of the jam clearance. Particularly, in the case where the accordion jam such that the recording material P was bellow-shaped on both of the upstream and downstream sides of the fixing device 14 occurred, even when the jammed paper was removed from either side of the upstream and downstream sides, there was a problem that the damage on the surface of the fixing roller 51 was not avoided. In this embodiment, in the fixing devices 141 and 142 mounted in the tandem type image forming apparatus (FIG. 5), the separating operation identical to the belt separating operation in the fixing device 14 in Embodiment 1 was performed. As a result, it was confirmed that the separating operation in this embodiment was more effective with respect to the operability of the jam clearance operation.

The fixing device 141 is the same fixing device as in Embodiment 1. In this embodiment, the fixing device 142 is provided separately. The fixing device 142 has a constitution including a second fixing roller as a second image heating member for heating the toner image heated by the fixing device 141 and including a second pressing belt as a second pressing member for forming a second nip in which the recording material is to be nipped and conveyed. In this embodiment, the second fixing roller and the second pressing belt have the same constitution as the fixing roller and the pressing belt in Embodiment 1. Further, as the contact-and-separation means for moving the second pressing belt toward and away from the second fixing roller, the fixing device 142 further includes a second fixing nip separation (removing) mechanism having the same constitution as the fixing nip separation mechanism in Embodiment 1. The second fixing nip separation mechanism is controlled by a control portion as a second executing portion so that the second fixing roller and the second pressing belt are placed in a separated state with a third distance during stand-by. In this embodiment, the third distance equals to the first distance in Embodiment 1, i.e., is about 1 mm. However, it is also possible to employ a constitution in which the distance in the downstream-side fixing device 142 is different from that in the upstream-side fixing device 141. Further, the fixing device 142 includes a second recording material detecting means for detecting the recording material present in the nip during the rest of the image forming operation. This detecting means has the same constitution as that of the detecting means including the introduction-side recording material detecting portion and the discharge-side recording material detecting portion provided in the fixing device in Embodiment 1. The fixing device 142 further includes a second contact-and-separation means control portion for controlling the operation of the contact-and-separation means so that the second fixing roller and the second pressing belt are separated at a fourth distance larger than the third distance when the presence of the recording material in the nip is detected. The fourth distance in this embodiment is equal to the second distance in Embodiment 1. That is, the fourth distance is about 5 mm which is the second distance but the distance in the downstream-side fixing device 142 may also be different from that in the upstream-side fixing device 141. Further, also in this embodiment, a second entrance guide as the introducing guide having the same constitution as that of the introducing guide in Embodiment 1 and a second discharging guide as the discharging guide having the same constitution as that of the discharging guide in Embodiment 1 are provided and are operated similarly as in Embodiment 1.

In each of the fixing devices 141 and 142 having the constitutions described above, the separating operation identical to the belt separating operation in the fixing device in Embodiment 1 was performed along the flow chart of FIG. 2. As a result, it was confirmed that the separating operation was more effective with respect to the operability of the jam clearance operation.

Another Embodiment

In Embodiment 1 and Embodiment 2, the fixing device including both of the introducing guide and the discharging guide is used. However, the fixing device is not limited thereto but may also include either one of the introducing guide and the discharging guide. In Embodiment 1 and Embodiment 3, as the example of the image forming apparatus, the color printer is used. However, the image forming apparatus is not limited thereto but may also be another image forming apparatus such as a copying machine or a facsimile machine. Further, in Embodiment 1 and Embodiment 3, the multi-color image forming apparatus capable of forming a color image is described. However, the image forming apparatus is not limited thereto but may also be, e.g., a monochromatic image forming apparatus capable of forming a monochromatic image. In the fixing device 14 in Embodiment 1, the belt 52 is moved but the fixing roller 51 may also be moved in place of the belt 52. In this case, the fixing roller 51 may only be required to be moved by the fixing nip separation mechanism 80. Further, in the fixing device 14 in Embodiment 2, the pressing roller 58 is moved but in place thereof, the fixing roller 51 may also be moved. In this case, the fixing roller 51 may only be required to be moved by the fixing nip separation mechanism 80.

In the above-described embodiments, the image heating member is heated by the heater but may also be heated by an induction heating method.

According to the present invention, it is possible to provide the image heating device capable of easily perform the jam clearance while decreasing the time required for returning the state thereof to be state in which the heating operation can be performed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 147329/2009 filed Jun. 22, 2009, which is hereby incorporated by reference.

What is claimed is:

1. An image heating apparatus comprising:

an image heating member configured to heat a toner image formed on a recording material at a nip in which the recording material is nipped when said apparatus operates in an image heating mode;

a pressing member configured to press said image heating member to form the nip with the image heating member;

recording material detecting abnormal conveyance of the recording material by said image heating member and said pressing member;

an interruption control portion configured to interrupt the image heating mode, based on the detecting result of said recording material detecting means;

a movable entrance guide configured to guide the recording material to the nip during the image heating mode; and a guide control portion configured to control moving of said movable entrance guide so that when said interruption control portion interrupts the image heating mode, the entrance guide is retracted from a position for guiding the recording material to the nip.

2. An apparatus according to claim 1, further comprising an executing portion configured to execute an operation in a stand-by mode in which said image heating apparatus is ready for input of an image heating signal, wherein said guide control portion controls moving of said movable entrance guide so that said entrance guide is provided at the position for guiding the recording material to the nip during the operation of said apparatus in the stand-by mode.

* * * * *